US010934710B2

(12) United States Patent
Wu et al.

(10) Patent No.: US 10,934,710 B2
(45) Date of Patent: Mar. 2, 2021

(54) PREFABRICATED SUPERIMPOSED RECYCLED LUMP CONCRETE SLAB AND CONSTRUCTION METHOD THEREOF

(71) Applicant: SOUTH CHINA UNIVERSITY OF TECHNOLOGY, Guangdong (CN)

(72) Inventors: Bo Wu, Guangdong (CN); Simin Jian, Guangdong (CN)

(73) Assignee: SOUTH CHINA UNIVERSITY OF TECHNOLOGY, Guangdong (CN)

( * ) Notice: Subject to any disclaimer, the term of this patent is extended or adjusted under 35 U.S.C. 154(b) by 0 days.

(21) Appl. No.: 16/472,213

(22) PCT Filed: Nov. 30, 2017

(86) PCT No.: PCT/CN2017/114150
§ 371 (c)(1),
(2) Date: Jun. 21, 2019

(87) PCT Pub. No.: WO2019/075870
PCT Pub. Date: Apr. 25, 2019

(65) Prior Publication Data

US 2019/0345715 A1 Nov. 14, 2019

(30) Foreign Application Priority Data

Oct. 16, 2017 (CN) ..... 201710975373.4

(51) Int. Cl.
*E04C 2/26* (2006.01)
*B28B 19/00* (2006.01)
(Continued)

(52) U.S. Cl.
CPC ..... *E04C 2/26* (2013.01); *B28B 19/0007* (2013.01); *B28B 23/02* (2013.01); *B28B 23/022* (2013.01); *E04C 2/526* (2013.01)

(58) Field of Classification Search
CPC . B28B 19/0007; B28B 23/024; B28B 23/022; E04C 2/26; E04C 2/526
(Continued)

(56) References Cited

U.S. PATENT DOCUMENTS 206,333 A * 7/1878 Hyatt ..... E01C 5/16 404/21
340,123 A * 4/1886 Johnson ..... E01C 5/16 404/21
(Continued)

FOREIGN PATENT DOCUMENTS

CA 2357834 A1 * 4/2002 ..... B28B 23/06
CH 270772 A * 9/1950 ..... B28B 19/0007
(Continued)

OTHER PUBLICATIONS

"International Search Report (Form PCT/ISA/210)", dated Jun. 13, 2018, with English translation thereof,pp. 1-4.

*Primary Examiner* — Michael Safavi
(74) *Attorney, Agent, or Firm* — JCIPRNET

(57) ABSTRACT

A prefabricated superimposed recycled lump concrete slab includes a fresh concrete, demolished concrete lumps, and a reinforcement fabric at a lower part of the slab. The demolished concrete lumps can protrude from the fresh concrete, but a protruding height is no more than 25 mm, and the protruding height is controlled by assembling molds. The assembling molds comprise casting molds and a height-controlling cover plate, reinforcement-locating slots are reserved on side molds of the casting molds, and a vertical position of the height-controlling is determined by using screws, position-controlling nuts and gaskets of different thicknesses, which are located at four corners of the casting molds. A construction method of the prefabricated superimposed recycled lump concrete slab is also provided.

6 Claims, 1 Drawing Sheet

(51) Int. Cl.
*B28B 23/02* (2006.01)
*E04C 2/52* (2006.01)

(58) Field of Classification Search
USPC ..... 264/259, 261, 275, 277; 404/15, 19, 20, 404/21; 249/96, 97
See application file for complete search history.

(56) References Cited

U.S. PATENT DOCUMENTS 451,466 A * 5/1891 Drake ..... E01C 5/00 404/19
1,474,481 A * 11/1923 King ..... B60C 11/14 404/19
1,549,951 A * 8/1925 Aiken ..... E04B 5/21 52/250
1,567,091 A * 12/1925 Tone ..... C04B 33/02 404/21
1,567,772 A * 12/1925 Tone ..... E01C 7/351 404/21
1,573,502 A * 2/1926 Peters ..... B28B 23/18 156/42
1,619,733 A * 3/1927 Jeppson ..... C04B 28/02 404/21
1,629,185 A * 5/1927 Tone ..... E04F 11/16 404/21
1,760,283 A * 5/1930 Pedersen ..... B28B 7/243 249/126
1,809,504 A * 6/1931 Carvel ..... B28B 19/0007 52/745.11
1,949,517 A * 3/1934 Van Der Pyl ..... C04B 28/04 428/15
2,046,213 A * 6/1936 Schnurer ..... E04C 2/40 52/384
2,234,663 A * 3/1941 Anderegg ..... B28B 23/04 264/228
2,630,614 A * 3/1953 Peterson ..... B28B 7/18 249/13
2,948,201 A * 8/1960 Nagin ..... E01C 7/356 404/21
3,331,175 A * 7/1967 Terrio ..... B28B 19/0007 52/315
3,608,051 A * 9/1971 Scott ..... B28B 7/342 264/261
3,689,626 A * 9/1972 Scott ..... B28B 7/0064 264/253
3,874,140 A * 4/1975 Seehusen ..... B28B 19/0007 52/315
4,020,211 A * 4/1977 Eigenmann ..... B29C 70/64 428/323
4,080,228 A * 3/1978 Currigan ..... E01C 23/082 156/247
4,662,972 A * 5/1987 Thompson ..... B32B 13/10 114/263
4,784,821 A * 11/1988 Leopold ..... B28B 19/0007 264/510
4,915,888 A * 4/1990 Sato ..... B28B 19/0007 264/71
4,945,694 A * 8/1990 Mitchell ..... B28B 23/00 52/223.1
5,079,095 A * 1/1992 Reed ..... E01C 7/18 404/19
5,624,615 A * 4/1997 Sandorff ..... B28B 7/0088 264/247
5,676,488 A * 10/1997 Hedblom ..... E01F 9/512 404/14
5,906,889 A * 5/1999 Miron ..... B32B 25/04 404/14
6,443,667 B2 * 9/2002 Brown ..... E02B 3/14 405/302.6
6,673,417 B1 * 1/2004 Gudet ..... B28B 3/021 15/215
6,861,141 B2 * 3/2005 Buccellato ..... C09J 4/00 404/14
2002/0073642 A1 * 6/2002 Calcote ..... B44C 3/12 52/603
2004/0182026 A1 * 9/2004 Clarke ..... B28B 7/0073 52/315
2006/0024132 A1 * 2/2006 Seman ..... A61H 3/066 404/15
2006/0140719 A1 * 6/2006 Groff ..... E01F 9/529 404/15
2006/0245827 A1 * 11/2006 Rydin ..... A61H 3/066 404/9
2007/0125017 A1 * 6/2007 Blount ..... E04C 5/085 52/223.1
2010/0183840 A1 * 7/2010 Logan ..... B28B 7/007 428/114
2014/0306088 A1 * 10/2014 Dryburgh ..... E04C 2/06 249/13

FOREIGN PATENT DOCUMENTS

CN 102677901 9/2012
CN 202482897 10/2012
CN 106088583 11/2016
DE 3147753 A1 * 6/1983 ..... B29C 67/243
DE 3416847 A1 * 11/1985 ..... B28B 7/364
FR 422184 A * 3/1911 ..... B28B 7/38
FR 2070325 A5 * 9/1971 ..... E04C 3/294
FR 2538293 A2 * 6/1984 ..... B28B 19/0007
FR 2600581 A1 * 12/1987 ..... B28B 19/0007
WO 2013050771 4/2013

* cited by examiner

PREFABRICATED SUPERIMPOSED RECYCLED LUMP CONCRETE SLAB AND CONSTRUCTION METHOD THEREOF

BACKGROUND

Technical Field

The present invention relates to the field of waste concrete recycling technologies, and more particularly, to a prefabricated superimposed recycle lump concrete slab and a construction method thereof.

Description of Related Art

Construction industrialization is one of the development trends of contemporary construction technology. Compared with a cast-in-situ concrete structure, a prefabricated concrete structure has the advantages of industrialized production, few wet constructions on-site, fast construction speed, energy conservation, etc. As an assembled monolithic member with excellent integrity, the prefabricated superimposed concrete slab has been widely used in prefabricated construction. Meanwhile, since the exploitation of natural sand and gravel damages the environment and the natural resources are decreasing day by day, the recycling of waste concrete, as a precious "special resource", has attracted extensive attention at home and abroad. Compared with recycled aggregates, the use of demolished concrete lumps with a larger size can greatly simplify the recycling process of the waste concrete, and meanwhile, the use of the demolished concrete lumps as concrete instead of the aggregates can also significantly reduce the consumption of cement, which has more obvious environmental protection benefits. However, the demolished concrete lumps cannot be used in a traditional prefabricated superimposed concrete slab due to the large size, and this problem needs to be solved urgently. The present invention allows the demolished concrete lumps to protrude from a fresh concrete while increasing a surface roughness of the prefabricated superimposed concrete slab, which is an effective way to solve this problem.

To sum up, the prior art has the problem that the demolished concrete lumps cannot be recycled in the prefabricated superimposed concrete slab due to the large size.

SUMMARY

An object of the present invention is to overcome the defects of the prior art, which on one hand allows demolished concrete lumps to protrude from a fresh concrete by a certain height, and limits the height by assembling molds, so that binding of reinforcements on a top of a slab during on-site construction is not affected by the demolished concrete lumps protruding out, so that the problem that the demolished concrete lumps cannot be recycled in a concrete prefabricated superimposed concrete slab due to large size is solved. On the other hand, the demolished concrete lumps protruding out can significantly increase a surface roughness of the prefabricated superimposed recycled lump concrete slab, thus improving integrity between the slab and a post-casting concrete layer.

Another object of the present invention is to provide a construction method of the prefabricated superimposed recycled lump concrete slab.

The objects of the present invention are achieved through one of the following technical solutions.

The prefabricated superimposed recycled lump concrete slab comprises the fresh concrete, the demolished concrete lumps and a reinforcement fabric at a lower part of the slab. The demolished concrete lumps are mixed with the fresh concrete, gaps between the demolished concrete lumps are filled with the fresh concrete, a ratio of a horizontal projected area of the demolished concrete lumps protruding from the fresh concrete to a surface area of the fresh concrete is no less than 1:3, a protruding height is no more than 25 mm, and the protruding height is controlled by the assembling molds. The assembling molds comprise casting molds and a height-controlling cover plate. Reinforcement-locating slots are reserved on side molds of the casting molds, and a vertical position of the height-controlling cover plate is determined by using screws, position-controlling nuts, and gaskets of different thicknesses, which are located at four corners of the casting molds.

Further, the demolished concrete lumps are lumps formed by crushing waste concrete of old buildings, roads, bridges or dams after removing protective layers and all or a part of reinforcements.

Further, the fresh concrete is a natural aggregate concrete or a recycled aggregate concrete with a compressive strength no less than 25 MPa, and a thickness of the fresh concrete after casting is no less than 60 mm.

Further, a characteristic size of the demolished concrete lumps ranges from 60 mm to 100 mm, and a mass ratio of the demolished concrete lumps to the fresh concrete ranges from 1:3 to 1:1.

Further, the reinforcement fabric at the lower part of the slab is formed by binding two groups of reinforcements which are perpendicular to each other, and a length of the reinforcements protruding from a side surface of the slab is required to meet lapping and anchoring requirements.

A construction method of the prefabricated superimposed recycled lump concrete slab comprises following steps:

(1) inserting the reinforcements through the reinforcement-locating slots reserved on the side molds of the casting molds, and binding the reinforcements to form the reinforcement fabric at the lower part of the slab;

(2) wetting the demolished concrete lumps in advance, putting the wetted demolished concrete lumps into an empty cavity surrounded by the side molds of the casting molds, and stirring the demolished concrete lumps to make them evenly distributed in the empty cavity;

(3) pouring sufficient fresh concrete into the empty cavity surrounded by the side molds of the casting molds, then placing the height-controlling cover plate on the gasket through the screws from top to bottom, and tightening the position-controlling nuts to prevent the protruding height from exceeding a limit value during vibrating; and (4) vibrating the prefabricated superimposed recycled lump concrete slab by using a vibrating table, and then steam curing the slab.

The present invention has the following advantages and effects relative to the prior art.

(1) The demolished concrete lumps are allowed to protrude from the fresh concrete by the certain height, and the height is limited by the assembling molds, so that the binding of reinforcements on the top of the slab during on-site construction is not affected by the demolished concrete lumps protruding out, so that the problem that the demolished concrete lumps cannot be recycled in the prefabricated superimposed concrete slab due to large size is solved.

(2) The demolished concrete lumps protruding from the fresh concrete can significantly increase the surface roughness of the prefabricated superimposed recycled lump concrete slab, and the integrity between the slab and the post-casting concrete layer can be ensured without a brooming process in a conventional construction process of the prefabricated superimposed concrete slab.

DESCRIPTION OF THE EMBODIMENTS

The present invention is further described in details below with reference to the embodiments and the drawings, but the implementation of the present invention is not limited thereto. It should be noted that all the processes hereunder can be implemented by those skilled in the art with reference to the prior art if not specifically described.

Figure 1:
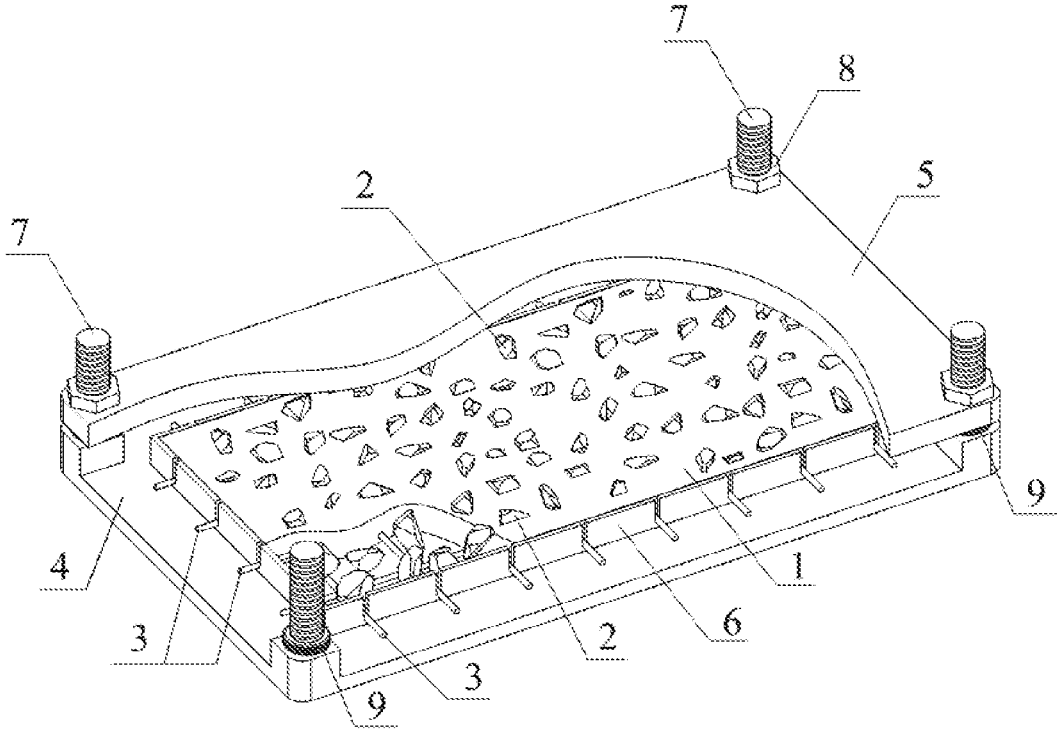
FIG. 1 is a schematic diagram of a prefabricated superimposed recycled lump concrete slab and assembling molds.
Figure 2:
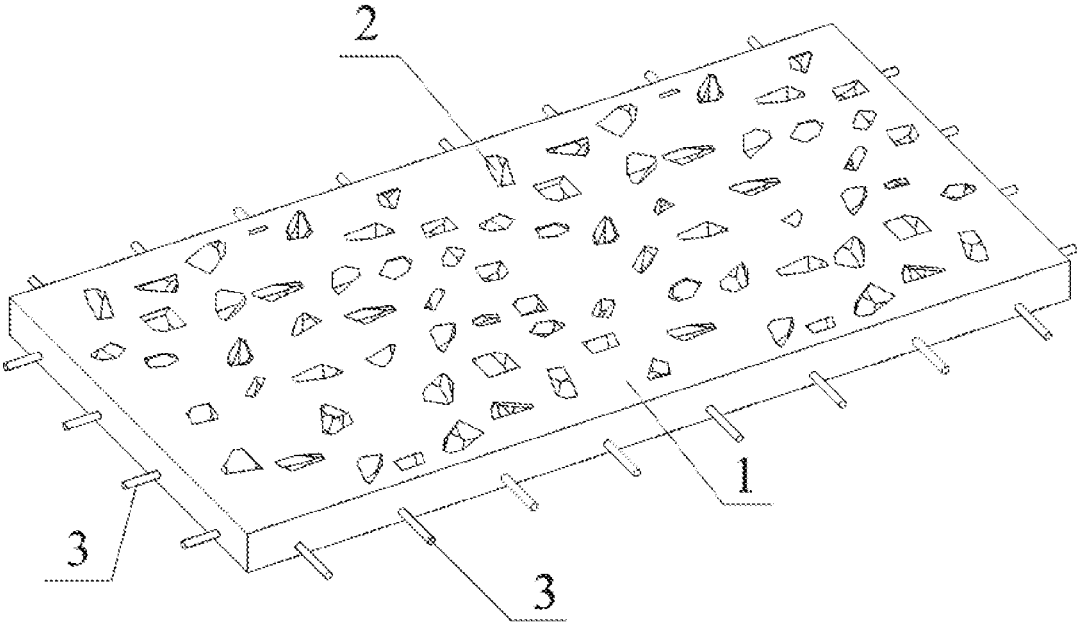
FIG. 2 is a schematic diagram of the prefabricated superimposed recycled lump concrete slab.

As shown in FIG. 1 and FIG. 2, a prefabricated superimposed recycled lump concrete slab comprises a fresh concrete 1, demolished concrete lumps 2 and a reinforcement fabric 3 at a lower part of the slab. The demolished concrete lumps are mixed with the fresh concrete, gaps between the demolished concrete lumps are filled with the fresh concrete, a ratio of a horizontal projected area of the demolished concrete lumps protruding from the fresh concrete to a surface area of the fresh concrete is no less than 1:3, a protruding height is no more than 25 mm, and the protruding height is controlled by assembling molds. The assembling molds comprise casting molds 4 and a height-controlling cover plate 5. Reinforcement-locating slots are reserved on side molds 6 of the casting molds, and a vertical position of the height-controlling cover plate is determined by using screw 7, position-controlling nuts 8 and gaskets 9 of different thicknesses, which are located at four corners of the casting molds.

In the embodiment, a width of the prefabricated superimposed recycled lump concrete slab is 1200 mm, and a span of the prefabricated superimposed recycled lump concrete slab is 3300 mm. A thickness of the fresh concrete 1 is 100 mm. A characteristic size of the demolished concrete lumps 2 is 60 mm to 100 mm.

In the embodiment, the reinforcement fabric 3 at the lower part of the slab is formed by binding two groups of reinforcements which are perpendicular to each other. The reinforcements in a span direction are Φ10@200, a length of the reinforcements protruding from a side surface of the slab is 150 mm. The reinforcements in a width direction are Φ8@200, the length of the reinforcements protruding from the side surface of the slab is 180 mm.

In the embodiment, a height of the side molds 6 of the casting molds 4 is 100 mm, and a spacing between the reserved reinforcement-locating sltos is 200 mm. After the height-controlling cover plate 5 is positioned, a net spacing between a bottom surface of the height-controlling cover plate 5 and a top surface of the side molds 6 is 25 mm.

A construction method of the prefabricated superimposed recycled lump concrete slab above comprises the following steps.

(1) Inserting the reinforcements through the reinforcement-locating slots reserved on the side molds 6 of the casting molds 4, and binding the reinforcements to form the reinforcement fabric 3 at the lower part of the slab.

(2) Wetting the demolished concrete lumps 2 in advance, putting the wetted demolished concrete lumps into an empty cavity surrounded by the side molds 6 of the casting molds 4, and stirring the demolished concrete lumps 2 to make them evenly distributed in the empty cavity.

(3) Pouring sufficient fresh concrete 1 into the empty cavity surrounded by the side molds 6 of the casting molds 4, then placing the height-controlling cover plate 5 on the gaskets through the screws 7 from top to bottom, and tightening the position-controlling nuts 8 to prevent the protruding height from exceeding a limit value during vibrating.

(4) Vibrating the prefabricated superimposed recycled lump concrete slab by using a vibrating table, and then steam curing the slab.

According to the method of the present invention, a series of embodiments can also be developed, which do not limit the present invention in any form. Therefore, any other amendment, modification, replacement, combination and simplification made without departing from the spiritual substance and principle of the present invention shall be deemed as equivalent substitute modes, and shall all fall within the protection scope of the present invention.

What is claimed is:

1. A prefabricated concrete slab, adapted to be integrated with post-casting concrete layer at a surface of the slab, the prefabricated concrete slab comprising a fresh concrete, a plurality of demolished concrete lumps and a reinforcement fabric at a lower part of the slab, the demolished concrete lumps are mixed with the fresh concrete, gaps between the demolished concrete lumps are filled with the fresh concrete, a ratio of a horizontal projected area of the demolished concrete lumps protruding from the fresh concrete to a surface area of the fresh concrete is no less than 1:3, a protruding height is no more than 25 mm, and the protruding height is limited by assembling molds; the assembling molds comprise casting molds and a height-controlling cover plate, reinforcement-locating slots are reserved on side molds of the casting molds, and a vertical position of the height-controlling cover plate is determined by using screws, position-controlling nuts and gaskets of different thicknesses, which are located at four corners of the casting molds, wherein a post-casting concrete layer is adapted to cover the slab, and the demolished concrete lumps are not exposed from the post-casting concrete layer.

2. The prefabricated concrete slab according to claim 1, wherein the demolished concrete lumps are lumps formed by crushing waste concrete of old buildings, roads, bridges or dams after removing protective layers and all or part of reinforcements.

3. The prefabricated concrete slab according to claim 1, wherein the fresh concrete is a natural aggregate concrete or a recycled aggregate concrete with a compressive strength no less than 25 MPa, and a thickness of the fresh concrete after casting is no less than 60 mm.

4. The prefabricated concrete slab according to claim 1, wherein a characteristic size of the demolished concrete lumps ranges from 60 mm to 100 mm, and a mass ratio of the demolished concrete lumps to the fresh concrete ranges from 1:3 to 1:1.

5. The prefabricated concrete slab according to claim 1, wherein the reinforcement fabric at the lower part of the slab is formed by binding two groups of reinforcements which are perpendicular to each other, and a length of the reinforcements protruding from a side surface of the slab is required to meet lapping and anchoring requirements.

6. A construction method of the prefabricated concrete slab according to claim 1, the construction method comprising following steps:

(1) inserting reinforcements through the reinforcement-locating slots reserved on the side molds of the casting molds, and binding the reinforcements to form the reinforcement fabric at the lower part of the slab;

(2) wetting the demolished concrete lumps in advance, putting the wetted demolished concrete lumps into an empty cavity surrounded by the side molds of the casting molds, and stirring the demolished concrete lumps to make them evenly distributed in the empty cavity;

(3) pouring sufficient fresh concrete into the empty cavity surrounded by the side molds of the casting molds, then placing the height-controlling cover plate on the gaskets by lowering the height-controlling cover plate over the screw down onto the gaskets, and tightening the position-controlling nuts to prevent the protruding height from exceeding a limit value during vibrating; and (4) vibrating the prefabricated concrete slab by using a vibrating table, and then steam curing the slab.

* * * * *